United States Patent [19]

McLean

[11] 4,382,357

[45] May 10, 1983

[54] SPINNING AND TWISTING RING CONSTRUCTION AND SYSTEM

[75] Inventor: James N. McLean, Tonawanda, N.Y.

[73] Assignee: Herr Manufacturing Company, Inc., Tonawanda, N.Y.

[21] Appl. No.: 321,746

[22] Filed: Nov. 16, 1981

[51] Int. Cl.[3] ..... D01H 7/62

[52] U.S. Cl. ..... 57/120

[58] Field of Search ..... 57/120

[56] References Cited

U.S. PATENT DOCUMENTS

| | | | |
|---|---|---|---|
| 2,760,329 | 8/1956 | Albrecht | 57/120 |
| 2,905,269 | 9/1959 | Mulholland | 57/120 |
| 3,964,576 | 6/1976 | Atwood et al. | 57/120 X |
| 4,098,067 | 7/1978 | McLean | 57/120 |

*Primary Examiner*—Donald Watkins

*Attorney, Agent, or Firm*—Joseph P. Gastel

[57] ABSTRACT

A spinning and twisting ring system including a plurality of holders, a ring in each of the holders, an annular conduit in each ring, a wick adapter block connected to each holder, a plurality of aligned bores in the ring, holder, and adapter block for containing a wick, a lubricant manifold, a plurality of spaced bores in the manifold, a lubricant conduit extending externally from each block and received in each of the bores in the manifold with the wick extending downwardly through the lubricant conduit and into lubricant in the manifold, with the lower end of each wick-receiving conduit being located in the lower portion of the manifold to assure contact between the wick and the lubricant.

9 Claims, 8 Drawing Figures

Fig. 1.
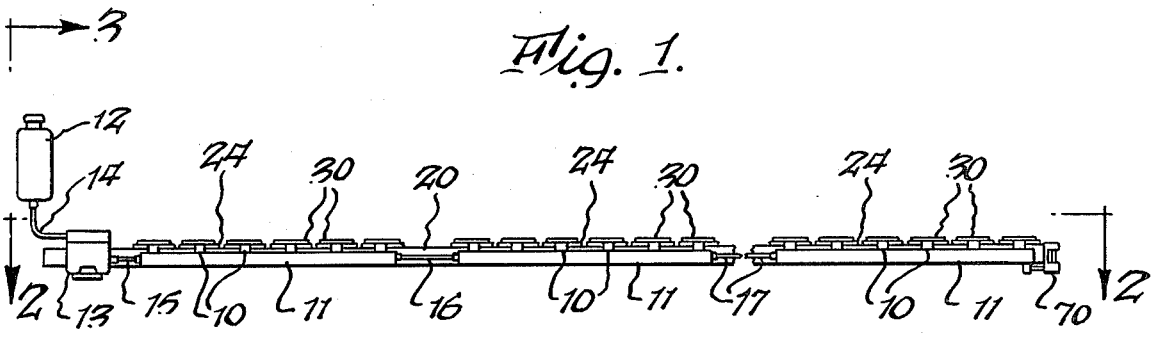
Fig. 2.
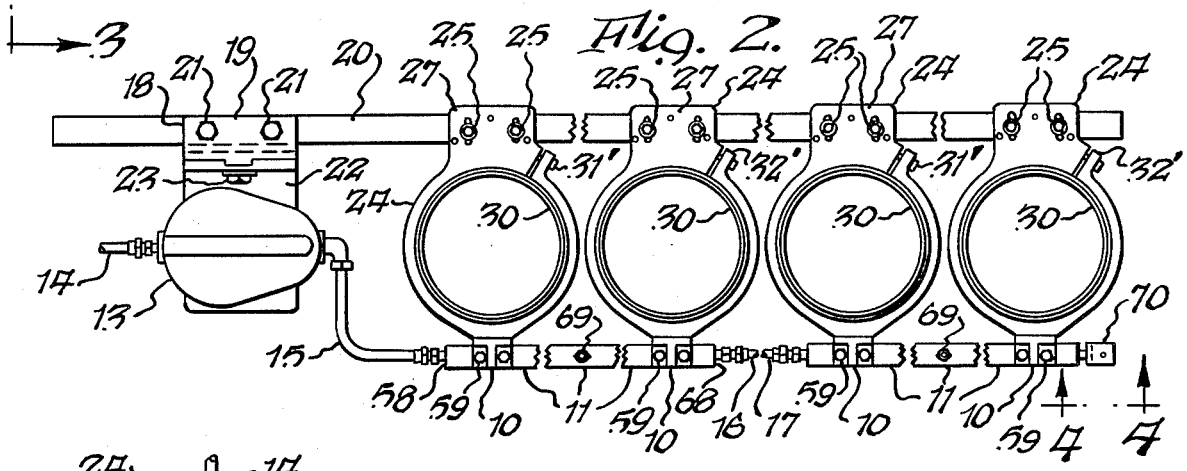
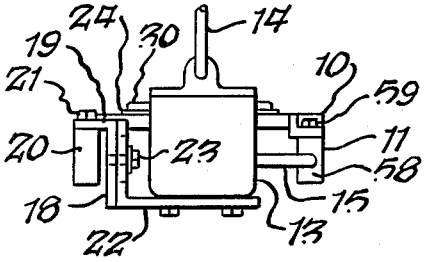
Fig. 3.
Fig. 4.
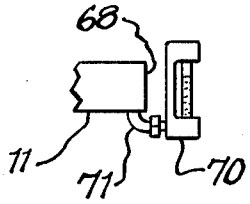
Fig. 5.
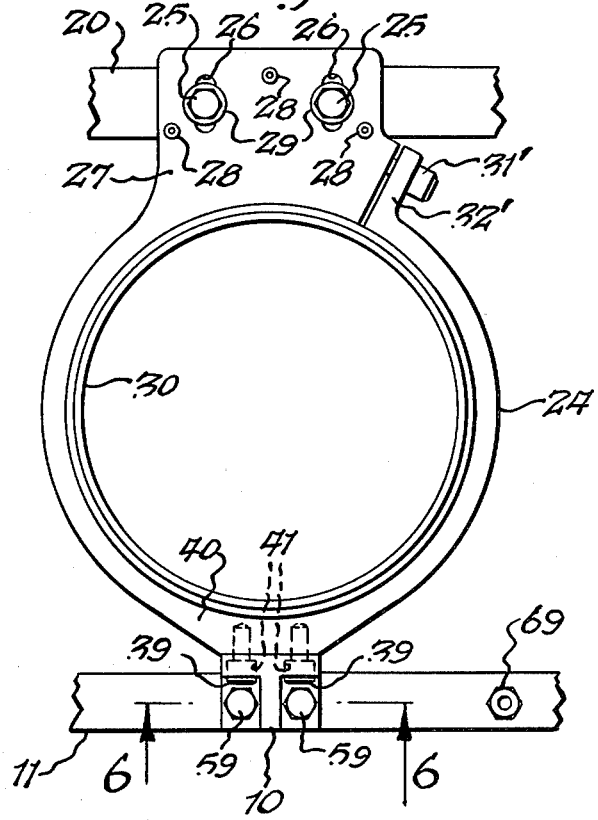

Fig. 6.
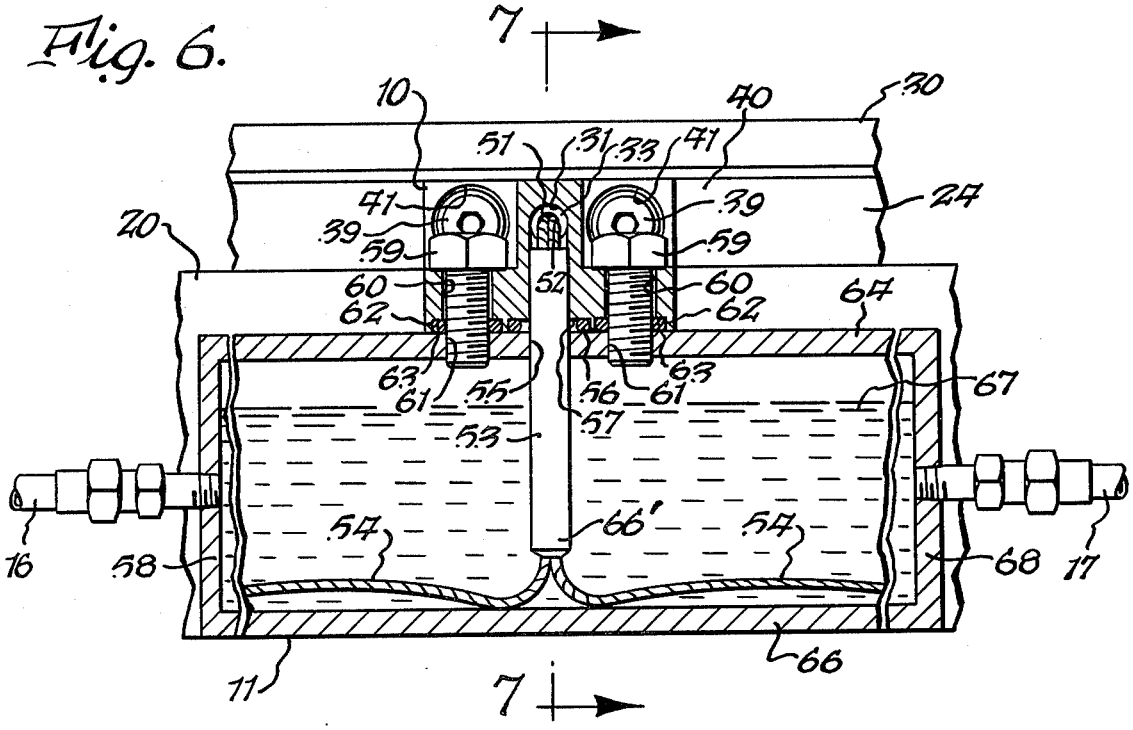
Fig. 7.
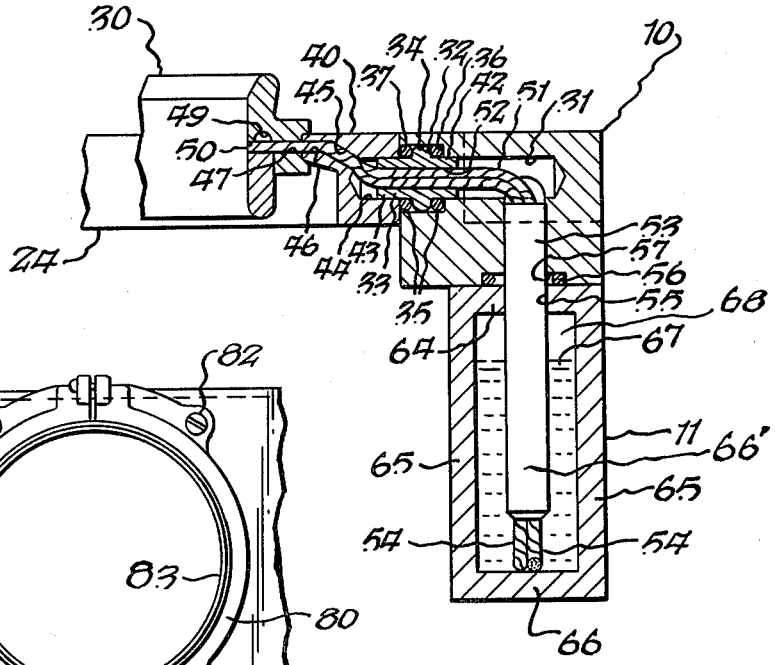
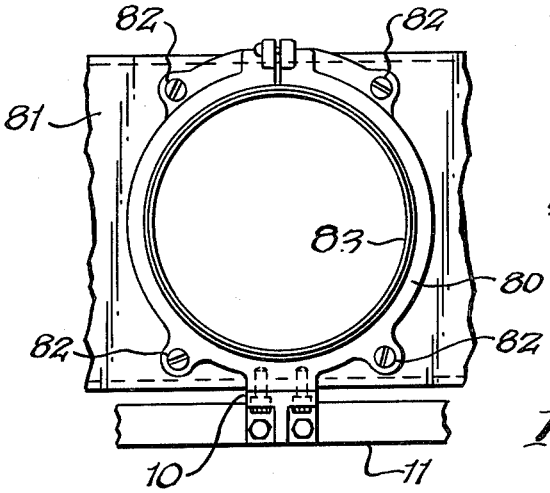
Fig. 8.

SPINNING AND TWISTING RING CONSTRUCTION AND SYSTEM

BACKGROUND OF THE INVENTION

The present invention relates to an improved wick-lubricated spinning and twisting ring construction and system.

By way of background, wick-lubricated spinning and twisting ring constructions and systems are well known. However, existing systems are subject to certain shortcomings. First of all, in existing systems the wick may lose contact with the lubricant and therefore the lubrication of the ring may be interrupted. Furthermore, in existing systems there are an excess number of fittings and points at which leakage of lubricant may occur and since most systems are series-connected, a leak in any part of the system will disrupt lubricant flow to the remainder of the system. Furthermore, in existing systems flow of lubricant is usually effected through a plurality of narrow conduits, which, if clogged, can result in the cessation of lubricant flow. It is with overcoming the foregoing deficiencies of prior art wick-lubricating systems that the present invention is concerned.

SUMMARY OF THE INVENTION

It is accordingly one object of the present invention to provide an improved wick-lubricated spinning and twisting ring construction in which immersion of the wicks is assured, thereby obviating the possibility of the wicks losing contact with the lubricant.

Another object of the present invention is to provide an improved wick-lubricated spinning and twisting ring construction wherein a plurality of rings are supplied with lubricant from a common lubricant manifold, thereby obviating the numerous conduits and connections which could provide sources of leakage.

A futher object of the present invention is to provide an improved wick-lubricating spinning and twisting ring, holder and block construction wherein the wicks are threaded through aligned conduits in the ring, holder and block in such a manner that pinching or kinking of the wicks is obviated, thereby assuring proper lubricant flow to the rings. Other objects and attendant advantages of the present invention will readily be perceived hereafter.

The present invention relates to a spinning and twisting ring construction comprising a holder, a ring in said holder, an annular conduit in said ring, a first wick-receiving bore in said ring extending transversely to said annular conduit, a second wick-receiving bore in said holder in alignment with said first wick-receiving bore, a wick adapter block connected to said holder, a third wick-receiving bore in said wick adapter block in alignment with said second wick-receiving bore, and a wick-receiving conduit extending outwardly from said wick adapter block.

The present invention also relates to a wick adapter block for attachment to a holder of a spinning and twisting ring comprising a wick-receiving bore in said block extending in a first direction, a wick-receiving conduit in communication with said wick-receiving bore and extending outwardly beyond said block in a second direction which is transverse to said first direction.

The present invention also relates to a wick adapter block and manifold construction for attachment to the holder of a spinning and twisting ring comprising a wick-receiving bore in said block extending in a first direction, a wick-receiving conduit in communication with said wick-receiving bore and extending outwardly beyond said block in a second direction which is transverse to said first direction, a lubricant manifold, a bore in said lubricant manifold for receiving the portion of said wick-receiving conduit which extends beyond said block, and a fluid tight seal between said block and said manifold.

The present invention also relates to a spinning and twisting ring system comprising a plurality of holders, a ring in each of said holders, an annular conduit in each ring, a first wick-receiving bore in each ring extending transversely to said annular conduit, a second wick-receiving bore in each holder in alignment with each first wick-receiving bore, a wick adapter block connected to each holder, a third wick-receiving bore in each wick adapter block in alignment with each second wick-receiving bore, a wick-receiving conduit extending downwardly and outwardly from each wick adapter block, a lubricant manifold, a plurality of spaced bores in said manifold for receiving wick-receiving conduits, means for securing said manifold to each of said wick adapter blocks, each of said wick-receiving conduits extending into said lubricant manifold through one of said spaced bores, a lubricant seal between each of said blocks and said manifold, each of said wick-receiving conduits including a lower portion and said lubricant manifold including a lower portion for receiving said lower portions of said wick-receiving conduits, and a wick extending through said first, second, and third wick-receiving bores and said wick-receiving conduit and extending beyond said wick-receiving conduit into said lower portion of said manifold.

The various aspects of the present invention will be more fully understood when the following portions of the specification are read in conjunction with the accompanying drawings wherein:

BRIEF DESCRIPTION OF THE DRAWINGS

FIG. 1 is a fragmentary side elevational view of a spinning and twisting ring installation including the improved construction mounted on the rail of a frame;

FIG. 2 is an enlarged fragmentary plan view of a portion of FIG. 1 taken substantially in the direction of arrows 2—2 of FIG. 1;

FIG. 3 is a fragmentary side elevational view taken substantially in the direction of arrows 3—3 of FIG. 1 and showing the mounting structure for adjusting the level of the lubricant float tank;

FIG. 4 is a fragmentary view taken substantially in the direction of arrows 4—4 of FIG. 2 and showing the lubricant level gauge associated with the manifold;

FIG. 5 is a fragmentary enlarged plan view of a holder mounted on the rail and mounting the manifold by means of the wick adapter block;

FIG. 6 is an enlarged fragmentary cross sectional view taken substantially along line 6—6 of FIG. 5;

FIG. 7 is a fragmentary cross sectional view taken substantially along line 7—7 of FIG. 6; and FIG. 8 is a fragmentary plan view of a ring and holder mounted on a flat rail and mounting the block and manifold of the present invention.

DESCRIPTION OF THE PREFERRED EMBODIMENTS

The improved lubrication system of the present invention which contains the improved wick adapter blocks 10 and the associated lubricant manifolds 11 is shown in the drawings. A lubricant gravity feed arrangement is provided wherein a lubricant reservoir or tank 12 feeds an automatic lubricant level tank 13 through conduit 14. Tank 13 essentially contains a float valve which terminates flow to conduit 15 when there is a predetermined level of lubricant in float tank 13. Conduit 15 is in communication with the lubricant manifold 11 to the left of FIG. 1, which is in communication with an adjacent lubricant manifold 11 through conduit 16, which in turn is in communication with an adjacent lubricant manifold 11 through conduit 17. A bracket 18 of tank mounting structure 19 is secured to rail 20 by means of screws 21. Tank mounting structure 19 includes an adjustable bracket 22 attached to bracket 19, and bracket 22 may be adjusted in elevation by moving it in a vertical direction and thereafter tightening it in its adjusted position by screw 23. In this manner the level of lubricant in float tank 13 may be adjusted relative to manifolds 11, to thereby adjust the level of lubricant in the latter.

A plurality of spinning and twisting ring holders 24 are cantilever-mounted on rail 20 by means of screws 25 passing through enlarged slots 26 in holder portions 27, screws 25 bearing downwardly on washers 29. The enlarged slots permit adjustment of the holders relative to rail 20. Leveling screws 28 thread into each holder 24 and bear on rail 20.

Each holder 24 mounts a spinning and twisting ring 30 and clamps it tightly by means of screw 31' which extends through ear 32' of the holder and connects to holder portion 27. Each ring 30 may be of the type shown in U.S. Pat. Nos. 4,098,067 or 3,831,367, or 3,872,662, and these patents are incorporated herein by reference.

In accordance with the present invention, a precise positive flow of lubricant is assured to each ring 30 through wick adapter blocks 10. In this respect, each block 10 includes a bore 31 which extends substantially horizontally and has an enlarged counterbore portion 32 in communication therewith. A connector member 33 is provided having cylindrical conduit ends 42 and 43 and a central enlarged annular portion 34 which is received in bore 32. O-rings 35 are located on opposite sides of enlarged portion 34. One O-ring 35 is located on conduit end 42 between annular portion 34 and shoulder 36 and the other O-ring 35 is located on conduit end 43 between annular portion 34 and edge 37 of holder 24. Block 10 is secured to holder 24 by means of screws 39 which are received in portion 40 of holder 24, with the heads of screws 39 being received in counterbores 41. As can be seen from FIG. 7, one end 42 of member 33 is received in bore 31 and the other end 43 is received in bore 44 of holder portion 40. Thus, member 33 is in alignment with bores 31 and 44, which are in alignment with each other.

A bore 45 in holder portion 40 is in communication with bore 44 and the end portion 46 of bore 45 is in alignment with a bore 47 in ring 30 which is in communication with annular conduit 49 in ring 30. A bore 50 is in line with bore 47. A wick 51 passes through bore 31, bore 52 in member 33, bores 44, 45 and 46 in the holder, and bores 47 and 50 in ring 30. The wick 51 also passes through wick-receiving conduit 53 which has its upper portion press-fitted into block 10 and the wick 51 has lower portions 54 which extend out from the lower portion of wick-receiving conduit 53.

Manifold 11 includes a plurality of spaced bores 55 through which each of the wick-carrying conduits 53 extend. An O-ring 56 is located in recessed portion 57 of block 10 surrounding each conduit 53. Each block 10 supports manifold 11 by means of a pair of screws 59 which extend through bores 60 in block 10 and are received in tapped bores 61 in manifold 11. O-rings 62 are provided in recesses 63 surrounding screws 59 so that when screws 59 are tightened, a fluid tight seal is provided between block 10 and the upper wall 64 of manifold 11, which is substantially rectangular in cross section and includes side walls 65 and bottom wall 66, and end walls 58 and 68 which mount fluid-tight connectors for the conduits, such as 15, 16 and 17.

The function of each wick-receiving conduit 53 is to cause the wick ends 54, which extend through the bottom portion 66' thereof, to be maintained in the lower portion of manifold 11 so that they will always be immersed in lubricant 67. In other words, conduit 53 prevents wick ends 54 from floating on top of the lubricant. In addition, the level of lubricant in manifold 11 is adjusted to be above the lower portion 66' of conduit 53 so that there will always be lubricant within conduit 53 and thus there will be not portion of the wick 54 adjacent conduit 53 which is exposed to the air, thereby enhancing the capillary action or feeding of lubricant to the ring 30.

Because of the foregoing construction, there is a relatively straight run of wick from the lowermost portion 66' of conduit 53 to bore 50 in ring 30. This being the case, pinching or kinking of wick 51 is virtually obviated, thereby assuring proper flow of lubricant therethrough. Furthermore, because the lower portion 66' of conduit 53 is in the lower portion of manifold 11, the constant immersion of wick portion 54 is assured.

While the wick is shown in FIG. 7 as ending in bore 50 of ring 30, it will be appreciated that the wick may be caused to pass throughout the annular conduit 49 in the manner fully described in U.S. Pat. No. 4,098,067, which is incorporated herein by reference.

The block and manifold construction described above is especially of interest in that it permits modification of lubricating systems in the field by placing existing rings into new holders, such as 24, having blocks, such as 10, which can be attached between them and manifold 11.

It is to be especially noted that since each manifold 11 is essentially a continuous sump which is associated with six rings, the number of potential leak points between rings is lessened. This can be readily appreciated with the manifold construction of the present invention is compared to the construction shown in U.S. Pat. No. 4,098,067 wherein conduits, such as 18, **18*a* and 18*b*, are positioned between blocks 21 and which require fittings for attaching the conduits to the blocks. The present manifold construction eliminates the conduits and the fittings and the potential leak points resulting from their use. Furthermore, the fact that the ends 54 of the wicks are submerged in the lubricant in manifold 11** practically assures a constant oil flow which was not assured in the prior art because the oil had to flow through narrow tubes.

The tubes 16 and 17 between adjacent manifolds are flexible so as to allow for variations in elevation between adjacent rails 20 if separate rails are used or to allow for flexing of the rail if a single rail is used.

Each manifold 11 is provided with a vent 69 in the form of a screw-in type of plug. This vent includes as filtering element therein which permits the air to pass into and out of manifold 11 so as to equalize the pressure therein with the atmosphere. If desired, vent plugs 69 may be screwed out of manifold 11 and the hole may be used for filling the manifold with an initial charge of lubricant.

In order to check the level of oil in manifolds 11, a sight gauge 70 is attached to the manifold 11 at the right of FIG. 1 and the sight gauge is in communication with the inside of manifold 11 through fitting 71.

The wick 51 may be two-ply 8's wool yarn or any other type of wick which is suitable for the intended purpose. Furthermore, if desired, a second lubricant tank 12 and float tank 13 may be located at the right end of a plurality of manifolds 11, in addition to these members at the left end, so that the manifolds 11 will be supplied from both lubricant tanks.

In FIG. 8, the improved wick adapter block 10 and manifold 11 are mounted on a holder 80 which is secured to a flat rail 81 by means of a plurality of screws 82, and ring 83 is mounted within holder 80. The only differences between the embodiment of FIG. 8 and those shown in the preceding figures is in the configuration of the holder 80 and the fact that the mounting of the holder is on flat rail 81 rather than rail 20 which provides a cantilever type of mounting. In other words, except for the configuration of the holder and the type of rail which is used, the ring 83, wick adapter block 10 and manifold 11 are identical to that described above in the preceding figures. The significance of FIG. 8 is to show that the wick adapter block 10 and manifold 11 can be used with any type of holder and rail.

While preferred embodiments of the present invention have been disclosed, it will be appreciated that the present invention is not limited thereto, but may be otherwise embodied within the scope of the following claims.

What is claimed is:

1. A spinning and twisting ring construction comprising a holder, a ring in said holder, an annular conduit in said ring, a first wick-receiving bore in said ring extending transversely to said annular conduit, a second wick-receiving bore in said holder in alignment with said first wick-receiving bore, a wick adapter block connected to said holder, a third wick-receiving bore in said wick adapter block in alignment with said second wick-receiving bore, and a wick-receiving conduit extending outwardly from said wick adapter block.

2. A spinning and twisting ring construction as set forth in claim 1 including a wick in said first, second, and third wick-receiving bores and in said wick-receiving conduit.

3. A spinning and twisting ring construction as set forth in claim 2 including a lubricant manifold mounted in sealed engagement with said adapter block, said wick-receiving conduit including a portion located within said lubricant manifold.

4. A spinning and twisting ring construction as set forth in claim 3 wherein said wick includes a portion which extends outwardly beyond said wick-receiving conduit.

5. A spinning and twisting ring construction as set forth in claim 4 wherein said lubricant manifold includes a lower portion and wherein said wick-receiving conduit includes a lower portion located within the lower portion of said lubricant manifold.

6. A wick adapter block for attachment to a holder of a spinning and twisting ring comprising a wick-receiving bore in said block extending in a first direction, a wick-receiving conduit in communication with said wick-receiving bore and extending outwardly beyond said block in a second direction which is transverse to said first direction.

7. A wick adapter block and manifold construction for attachment to the holder of a spinning and twisting ring comprising a wick-receiving bore in said block extending in a first direction, a wick-receiving a wick adapter block and manifold construction for attachment to the holder of a spinning and twisting ring comprising a wick-receiving bore in said block extending in a first direction, a wick-receiving.

8. A spinning and twisting ring construction as set forth in claim 7 wherein said lubricant manifold includes a lower portion and wherein said wick-receiving conduit includes a lower portion located within the lower portion of said lubricant manifold.

9. A spinning and twisting ring system comprising a plurality of holders, a ring in each of said holders, an annular conduit in each ring, a first wick-receiving bore in each ring extending transversely to said annular conduit, a second wick-receiving bore in each holder in alignment with each first wick-receiving bore, a wick adapter block connected to each holder, a third wick-receiving bore in each wick adapter block in alignment with each second wick-receiving bore, a wick-receiving conduit extending downwardly and outwardly from each wick adapter block, a lubricant manifold, a plurality of spaced bores in said manifold for receiving wick-receiving conduits, means for securing said manifold to each of said wick adapter blocks, each of said wick-receiving conduits extending into said lubricant manifold through one of said spaced bores, a lubricant seal between each of said blocks and said manifold, each of said wick-receiving conduits including a lower portion and said lubricant manifold including a lower portion for receiving said lower portions of said wick-receiving conduits, and a wick extending through said first, second, and third wick-receiving bores and said wick-receiving conduit and extending beyond said wick-receiving coniduit into said lower portion of said manifold.

* * * * *